US005393408A

United States Patent [19]

Ziemer et al.

[11] Patent Number: 5,393,408

[45] Date of Patent: Feb. 28, 1995

[54] PROCESS FOR THE STABILIZATION OF LUBRICATING OIL BASE STOCKS

[75] Inventors: James N. Ziemer, Hercules; John M. Rosenbaum, Richmond; Kristine L. Eiden, Larkspur, all of Calif.

[73] Assignee: Chevron Research and Technology Company, San Francisco, Calif.

[21] Appl. No.: 877,434

[22] Filed: Apr. 30, 1992

[51] Int. Cl.[6] ..... C10G 65/02; C10G 65/08

[52] U.S. Cl. ..... 208/57; 208/49

[58] Field of Search ..... 208/57

[56] References Cited

U.S. PATENT DOCUMENTS

| | | | |
|---|---|---|---|
| 3,637,484 | 1/1972 | Hansford | 208/143 |
| 3,637,878 | 1/1972 | Hansford | 260/667 |
| 3,654,132 | 4/1972 | Christman et al. | 208/57 |
| 3,700,584 | 10/1972 | Johanson et al. | 208/57 |
| 3,702,291 | 11/1972 | Jacquin et al. | 208/57 |
| 3,703,461 | 11/1972 | Hansford | 208/143 |
| 3,767,562 | 10/1973 | Sze et al. | 208/57 |
| 3,852,207 | 12/1974 | Stangeland et al. | 208/58 |
| 3,962,071 | 6/1976 | Itoh et al. | 208/58 |
| 4,139,493 | 2/1979 | Mickelson | 252/455 R |
| 4,251,347 | 2/1981 | Rausch et al. | 208/57 |
| 4,263,127 | 4/1981 | Rausch et al. | 208/57 |
| 4,325,805 | 4/1982 | Miller | 208/58 |
| 4,342,641 | 8/1982 | Reif et al. | 208/57 |
| 4,601,996 | 7/1986 | Miller | 502/242 |
| 4,786,402 | 11/1988 | Anstock et al. | 208/57 |
| 4,810,355 | 3/1989 | Hopkins | 208/57 |
| 4,828,675 | 5/1989 | Sawyer et al. | 208/57 |
| 5,068,025 | 11/1991 | Bhan | 208/57 |
| 5,100,855 | 3/1992 | Clark et al. | 502/211 |

*Primary Examiner*—Helane Myers

*Attorney, Agent, or Firm*—C. J. Caroli; J. A. Scholten

[57] ABSTRACT

A process is disclosed for producing a hydrogenated lubricating oil base stock having improved stability. A lube oil base stock is contacted with hydrogen in a first hydrogenation zone under hydrogenation reaction conditions in the presence of a macroporous hydrogenation catalyst comprised of a particulate refractory inorganic oxide support component and a hydrogenation component. The macroporous hydrogenation catalyst has an acid site density of between about 0.015 and about 0.3 milliequivalents per gram of catalyst, a total pore volume greater than about 0.45 $cm^3/g$, and at least 10% of the total pore volume in macropores of diameter is greater than about 1000 Angstroms. A portion of the effluent from the first step is then contacted with hydrogen in a second hydrogenation zone under hydrogenation reaction conditions in the presence of a mesoporous hydrogenation catalyst comprised of a particulate refractory inorganic oxide support component and a hydrogenation component. The catalyst has an acid side density of between about 0.015 and about 0.3 milliequivalents per gram of catalyst, a total pore volume greater than about 0.30 $cm^3/g$, and has less that 10% of the total pore volume in macropores of diameter greater than about 1000 Angstroms. A lube oil base stock is then recovered which has improved stability.

40 Claims, 1 Drawing Sheet

PROCESS FOR THE STABILIZATION OF LUBRICATING OIL BASE STOCKS

FIELD OF THE INVENTION

The present invention relates to a hydrogenation catalyst system and its use in hydrogenating a lubricating oil base stock in order to improve its stability.

BACKGROUND OF THE INVENTION

Lubricating oil base stocks that are used to prepare lubricating oils are highly colored and are unstable in the presence of oxidizing agents and UV light. Upon exposure of the lubricating oil or the base stock to an oxidizing agent or to UV light, a precipitate may form which affects the quality of the product. Lubricating oil base stocks that have been recovered as distillates from a hydrocracking zone in particular contain olefin and aromatic components that impart poor stability to the lubricating oil. Hydrogenation of the lubricating oil base stock, often referred to in the art as hydrofinishing, is a known method for improving the stability of lubricating oils.

U.S. Pat. No. 3,852,207 to Stangeland et al., discloses a catalytic hydrogenation process for lubricating oil which involves a hydrogenation catalyst comprising a refractory oxide and a platinum group metal.

U.S. Pat. No. 3,962,071 to Itoh et al., claims a process which includes hydrocracking, fractionation, and hydrogenation for enhancing lubricating oil photostability. In Itoh et al., the hydrogenation catalyst includes palladium on a silica containing refractory inorganic oxide carrier having 5–40 weight percent silica, a surface area of 100–500 $m^2/g$, a pore volume of 0.5–1.2 ml/g, an average pore diameter of 30–120 Angstroms, and a bulk density of 0.5–0.7 g/ml.

U.S. Pat. No. 3,637,484, U.S. Pat. No. 3,637,878, and U.S. Pat. No. 3,703,461, all to Hansford, disclose a process for hydrogenating an aromatic hydrocarbon feedstock with a catalyst having a support composed of a silica-alumina cogel in a large pore alumina gel matrix and containing a platinum group metal. The catalyst composition of Hansford has a pore volume of 0.8–2.0 ml/g with about 0.3–1.0 ml/g of the pore volume in pores of diameter greater than about 500 Angstroms. In Hansford, the support employs a relatively high ratio of alumina to silica, always in excess of 60 weight percent of alumina as compared to silica. Conversely, supports having high ratios of silica to alumina have been disclosed in U.S. Pat. Nos. 4,139,493; 4,325,805; and 4,601,996. However, catalysts containing higher ratios of silica to alumina generally contain a hydrogenation component other than a platinum group metal, commonly nickel, tin, molybdenum, or cobalt.

Nevertheless, the hydrogenation processes available in the art for stabilizing lubricating oil base stocks do not adequately address the problem of catalyst fouling. Producing base stocks of high stability requires removing unstable hydrocarbon molecules to very low levels. A hydrogenation process employing a single hydrogenation catalyst will not easily accomplish this while maintaining acceptable catalyst activity. We have now discovered a unique layered catalyst system having a low rate of catalyst deactivation and a high activity when used for stabilizing a lubricating oil base stock.

SUMMARY OF THE INVENTION

Accordingly, a process is provided for stabilizing lubricating oil base stock with a hydrogenation catalyst system having high activity and resistance to aging. In particular a process is provided for producing a lubricating oil base stock having improved stability. More specifically, a process is provided for producing a hydrogenated lubricating oil base stock having improved stability comprising the steps of:

(a) contacting the lubricating oil base stock with hydrogen in a first hydrogenation zone under hydrogenation reaction conditions in the presence of a macroporous hydrogenation catalyst comprising a particulate refractory inorganic oxide support component and a hydrogenation component, said macroporous hydrogenation catalyst having:
  (i) an acid site density of between about 0.015 and about 0.3 milliequivalents per gram of catalyst;
  (ii) a total pore volume greater than about 0.45 $cm^3/g$; and
  (iii) at least 10% of the total pore volume being in macropores of diameter greater than about 1000 Angstroms;

(b) contacting at least a portion of the effluent from step (a) with hydrogen in a second hydrogenation zone under hydrogenation reaction conditions in the presence of a mesoporous hydrogenation catalyst comprising a particulate refractory inorganic oxide support component and a hydrogenation component, said mesoporous hydrogenation catalyst having
  (i) an acid site density of between about 0.015 and about 0.3 milliequivalents per gram of catalyst;
  (ii) a total pore volume greater than about 0.30 $cm^3/g$; and
  (iii) less than 10% of the total pore volume being in macropores of diameter greater than about 1000 Angstroms; and (c) recovering a lubricating oil base stock having improved stability.

In an alternate embodiment of the present invention, the first hydrogenation zone will contain a mesoporous hydrogenation catalyst and the second hydrogenation zone will contain a macroporous hydrogenation catalyst. In accordance with this aspect of the invention, a process is provided for producing a hydrogenated lubricating oil base stock having improved stability comprising the steps of:

(a) contacting the lubricating oil base stock with hydrogen in a first hydrogenation zone under hydrogenation reaction conditions in the presence of a mesoporous hydrogenation catalyst comprising a particulate refractory inorganic oxide support component and a hydrogenation component, said mesoporous hydrogenation catalyst having
  (i) an acid site density of between about 0.015 and about 0.3 milliequivalents per gram of catalyst;
  (ii) a total pore volume greater than about 0.30 $cm^3/g$; and
  (iii) less than 10% of the total pore volume being in macropores of diameter greater than about 1000 Angstroms;

(b) contacting at least a portion of the effluent from step (a) with hydrogen in a second hydrogenation zone under hydrogenation reaction conditions in the presence of a macroporous hydrogenation catalyst comprising a particulate refractory inorganic oxide support component and a hydrogenation component, said macroporous hydrogenation catalyst having (i) an acid site density of between about 0.015 and about 0.3 milliequivalents per gram of catalyst;

(ii) a total pore volume greater than about 0.45 $cm^3/g$; and (iii) at least 10% of the total pore volume being in macropores of diameter greater than about 1000 Angstroms; and (c) recovering a lubricating oil base stock having improved stability.

Typically, the hydrogenation components of the macroporous hydrogenation catalyst and the mesoporous hydrogenation catalyst will be independently selected from the group consisting of the platinum group metals, nickel, cobalt, chromium, molybdenum, tungsten, and tin. The oxide support components of both the macroporous hydrogenation catalyst and the mesoporous hydrogenation catalyst preferably comprise silica and alumina, more preferably a silica/alumina base material in an alumina gel matrix, said silica/alumina base material preferably comprising at least 30 weight percent silica, and more preferably comprising at least 40 weight percent silica. It is within the scope of the present process that the preferred acid site density on the hydrogenation catalysts be achieved by selecting a base material having an appropriate silica/alumina ratio, or by including acidic materials such as halides or crystalline zeolites in the catalysts. Acid site density may also be increased by the use of base materials having low levels, preferably less than 500 ppm each, of tramp metals, including sodium, iron, potassium, calcium, and magnesium.

Among other factors, the present invention is based on the surprising discovery of increased catalyst activity and catalyst life and improved hydrogenated lubricating oil base stock stability when the lubricating oil base stock is hydrogenated in the presence of a layered catalyst system containing a macroporous hydrogenation catalyst in a first hydrogenation zone and a mesoporous hydrogenation catalyst in a second hydrogenation zone. Alternatively, the layered catalyst system may contain a mesoporous hydrogenation catalyst in the first hydrogenation zone and a macroporous hydrogenation catalyst in the second hydrogenation zone.

DETAILED DESCRIPTION OF THE INVENTION

Figure 1:
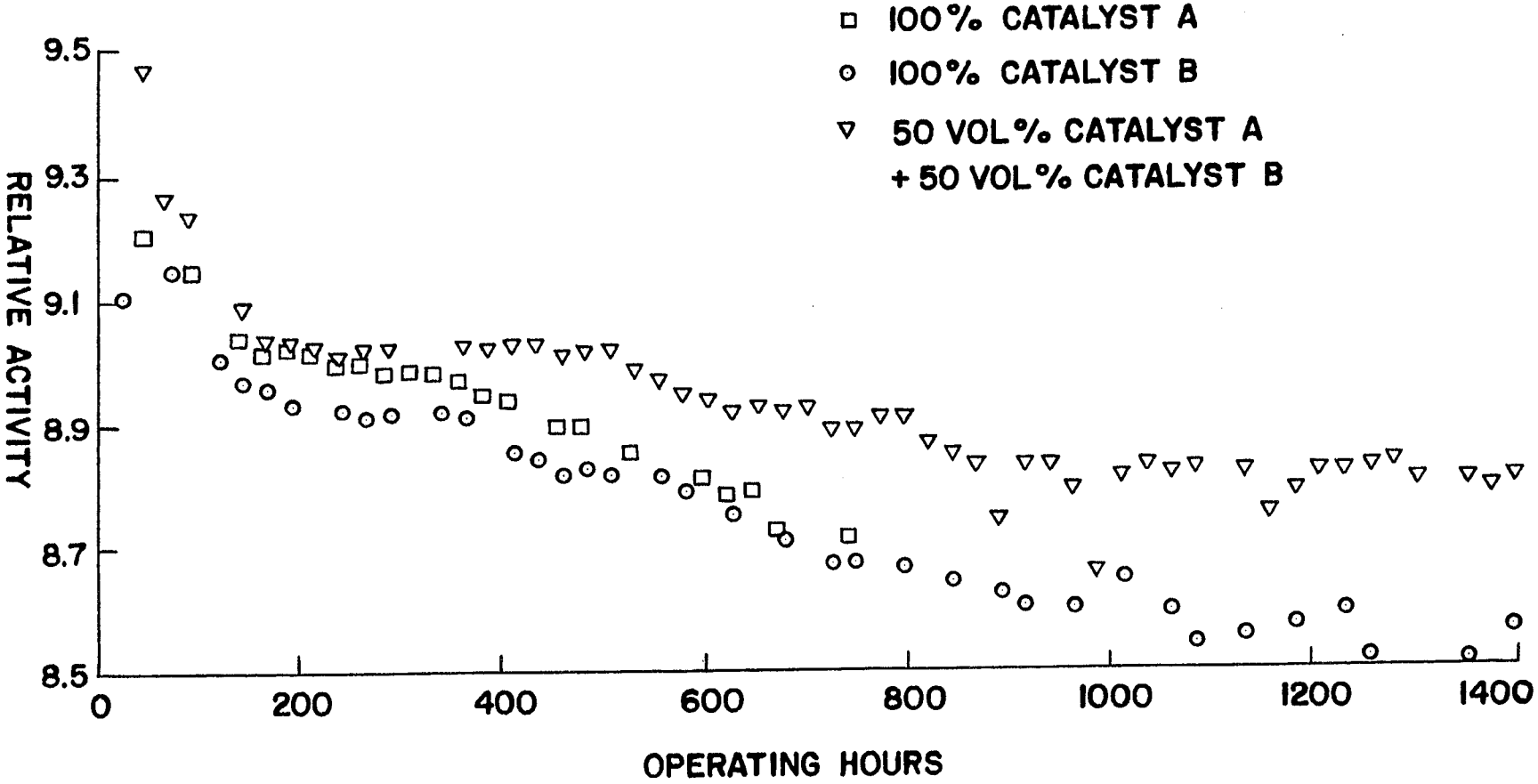
FIG. 1 is a plot showing the trend of relative activity vs. operating hours in the hydrogenation of lubricating oil base stock using (1) a macroporous hydrogenation catalyst (Catalyst A); (2) a mesoporous hydrogenation catalyst (Catalyst B); and (3) a layered catalyst system in accordance with this invention comprising a hydrogenation zone containing a macroporous catalyst followed by a hydrogenation zone containing a mesoporous catalyst (Catalyst A+Catalyst B).

The improved process of the present invention is directed toward improving the stability of lubricating oil base stock. Lubricating oil base stock, particularly lubricating oil base stock that has been recovered from a hydrocracking zone, is known to contain trace quantities of unstable components, generally polycyclic aromatic components and nitrogen heterocycles, which tend to affect the quality of the final product. Instability is usually characterized by the rapid uptake of oxygen, the formation of a precipitate or flocculent in the base stock, and/or by the darkening of the base stock. Exposure to an oxidizing agent or to UV light for even a brief period of time tends to accelerate the formation of the unstable molecular constituents of the oil. One useful method for measuring the tendency of lubricating oil base stocks toward oxidation is the "Oxidator BN". "Oxidator BN" measures the time, generally in hours, for 100 grams of oil to absorb one liter of oxygen. This method is described in U.S. Pat. No. 3,852,207, the disclosure of which is herein incorporated by reference.

Lubricating oil base stocks may also be characterized by their absorbance of ultraviolet radiation at reference wavelengths of 226 nm (nanometers) and at 305 nm using standard ultraviolet spectroscopic techniques, as described, for example, in ASTM D2008-85. Increased absorbance at the reference wavelengths often indicates higher concentrations of potentially unstable species in the lubricating oil base stock. In particular, molecular species which absorb ultraviolet radiation having a wavelength of 226 nm are frequently the molecular species which are susceptible to oxidation in lubricating oil base stocks. Likewise, the molecular species which absorb ultraviolet radiation having a wavelength of 305 nm or higher are frequently responsible for the flocculation and darkening of the lubricating oil. In the practice of the present hydrogenation process, the saturation of olefins and aromatics in the lubricating oil base stocks and removal of color bodies and flocculent precursors to improve the stability and quality of the hydrogenated lubricating oil base stocks are enhanced as compared to the processes available in the art.

Hydrogenation Catalyst System

A surprising aspect of the process of the present invention is the effect of the pore structure of the catalyst system on both catalyst activity and catalyst life during hydrogenation of lubricating oil base stocks. An important distinction between the macroporous hydrogenation catalyst of the first hydrogenation zone and the mesoporous hydrogenation catalyst of the second hydrogenation zone is the amount of total pore volume of each which is present in macropores. Thus, the hydrogenation catalyst system which is employed in the present invention comprises a first hydrogenation zone containing a macroporous hydrogenation catalyst having a total pore volume greater than about 0.45 $cm^3/g$, preferably greater than about 0.55 $cm^3/g$, with at least 10% of the total pore volume being in macropores of diameter of greater than about 1000 angstroms, with the minimum amount of macropore volume preferably being greater than 0.07 $cm^3/g$; and a second hydrogenation zone containing a mesoporous hydrogenation catalyst having a total pore volume of greater than about 0.30 $cm^3/g$, preferably greater than about 0.35 $cm^3/g$, with less than 10% of the total pore volume being in macropores of diameter greater than about 1000 angstroms, with the maximum amount of macropore volume preferably being 0.07 $cm^3/g$. Typically, the macroporous catalyst support component and the mesoporous catalyst support component will have surface areas of greater than about 100 $m^2/g$, and preferably greater than about 250 $m^2/g$.

As noted above, in an alternate embodiment of the invention, the first hydrogenation zone will contain the mesoporous hydrogenation catalyst and the second hydrogenation zone will contain the macroporous hydrogenation catalyst.

As used herein, the term "macroporous" refers to a catalyst having a relatively large amount of pore volume, i.e., at least 10%, in pores of diameter greater than about 1000 Angstroms, with a minimum macropore volume preferably being greater than 0.07 $cm^3/g$. The term "mesoporous" refers to a catalyst having a relatively small amount of pore volume, i.e., less than 10%, in pores of diameter greater than about 1000 Angstroms, with a maximum macropore volume preferably being 0.07 $cm^3/g$. Also, the term "macropore volume", as used herein, is meant to indicate the amount of pore volume which is present in pores of diameter greater than about 1000 Angstroms. Moreover, although the total pore volumes of the macroporous and mesoporous catalysts will generally differ, the actual macropore volume of the macroporous catalyst will, as a rule, be greater than the actual macropore volume of the mesoporous catalyst.

The relative amounts of catalyst in the first and second hydrogenation zones will depend on the type of feed being processed. Typically, the volume ratio of first hydrogenation zone catalyst to second hydrogenation zone catalyst will be between about 90:10 and about 10:90, and preferably between about 75:25 and about 25:75.

The catalysts employed in the present invention contain a catalyst support that is generally prepared from silica/alumina base materials. The distribution of silica and alumina in the support may be either homogeneous or heterogeneous, but is preferably heterogeneous. A homogeneous distribution is ordinarily obtained when the silica/alumina ratio is uniform throughout the support, resulting for example from conventional coprecipitation or congelation techniques. These homogeneous supports, wherein the necessary silica content is uniformly distributed, are difficult to prepare in the large-pore forms required herein. Pure alumina, on the other hand, can readily be prepared in these forms, preferably using acid or base peptization methods. A preferred form of the support consists of an alumina gel in which is dispersed the silica/alumina base material, which form is referred to herein as the "heterogeneous" support. The alumina gel is also referred to herein as the "oxide binder." The support may also contain refractory materials other than alumina or silica, such as for example other inorganic oxides or clay particles, provided that such material does not adversely affect the hydrogenation activity of the final catalyst. Other inorganic oxides that may be present in the support may include, but are not necessarily limited to, titania, magnesia and zirconia or combinations thereof. Generally, silica/alumina will make up at least 90 weight percent of the entire support, and most preferably the support will be substantially all silica/alumina.

Although not wishing to be bound by any theory, we believe that percent macropore volume is dependent on a number of factors, including the degree of mixing, the characteristics of the raw materials (such as alumina) used, and, when using an acid or base peptization procedure, the amount of and type of acid (or base) used. The degree of mixing in turn depends on the specific equipment used, the time of mixing and the energy input by the mixer. In general, the percent of macropores can be reduced by increasing the degree of mixing. Conversely, less mixing leads to more macropores. Energy input during catalyst forming (e.g., extrusion) also affects the percent of macropore volume.

As stated above, the support is preferably prepared by mixing the base material with a peptized oxide binder, such as alumina, which has been treated with an acid, generally a strong acid such as nitric, acetic, or hydrochloric acids. Generally, the weight ratio of base material to oxide binder is in the range from 96/4 to 30/70. Pore size is in part controlled in supports prepared as described herein by the length of time that the oxide binder is exposed to the acid during the peptizing step, and by the amount of acid used. To prepare the particulate refractory inorganic support for the macroporous catalyst, the base material is mixed with an oxide binder which has been treated with typically less than about 3 weight percent of 100% pure acid (based on the weight of total calcined solids). The particulate refractory inorganic support for the mesoporous catalyst is likewise prepared by mixing the base material with a oxide binder which has been treated with preferably about 4 weight percent to about 12 weight percent of 100% pure acid (based on the weight of total calcined solids). The proportion of acid will vary depending on the type of acid, the reactivity of the raw material powders, the type of mixing equipment, and the mixing time, temperature, etc.

The support used in the practice of the present invention is a particulate support. The exact size and shape of the catalyst support particles will vary depending on the particular method that will be used to hydrogenate the lubricating oil base stock. Most commonly, the support is formed into pellets of an appropriate size, normally at least 1/32 inch in diameter. As used herein, the term "pellets" is intended to include extrudates, prills, beads, tablets or any other suitable granular form. Pellets are preferred for use in hydrogenation processes employing packed beds and moving beds. However, for other processes, such as for use in a fluidized bed, it may be desirable for the support to be in a finely divided form such as a powder. When the support is to be extruded in the preparation of the catalyst materials, mixing the base material with the peptized oxide binder enhances the extrusion process and improves the strength of the completed catalyst pellets. The extrudate is usually dried and calcined in an oven to produce the support. After calcining, the support is ready for the addition of the hydrogenation component of the catalyst.

Pore size distribution for the catalysts employed in the present invention is determined using mercury intrusion porosimetry as described, for example, in ASTM D4284, "Pore Volume Distribution of Catalysts by Mercury Intrusion Porosimetry." According to this procedure, a catalyst is heated at 450° C. in a vacuum for 30 minutes to remove water vapor and other volatiles. A weighed portion of sample (0.3–0.5 g, depending on the total pore volume estimate) is placed in a volume-calibrated sample tube. The tube is filled with mercury and inserted into the pressurization chamber of a Quantachrome Auto-Scan Porosimeter. The pressure in the chamber is increased from 0 to 60,000 psig. As the pressure increases, the volume of mercury in the sample tube appears to decrease as the mercury intrudes into the pores of the sample. Apparent mercury volume is obtained as a function of the applied pressure. Apparent mercury volume and applied pressure are then related to pore volume (V) and pore diameter (D), respectively. Results are reported as plots of pore volume (in $cm^3$) and cumulative pore volume ($cm^3$) as a function of pore diameter (in angstroms). Analysis of the data gives the percent macropore volume according to the formula: Percent Macropore Volume=(macropore volume/total pore volume)×100.

It has further been discovered that acid sites within a range of acid site densities are important for the hydrogenation catalysts of the process of this invention. The prior art has generally taught that the preferred support should have minimal potential acid sites which are known to catalyze undesirable hydrocracking and isomerization reactions in the hydrogenation zone. In contrast, we have unexpectedly found that potential acid sites increase both the activity and the catalyst stability of the present catalysts. Typically, the acid site density of the catalysts useful for the present process is in the range of 0.015 to 0.30, preferably in the range of 0.10 to 0.20 milliequivalents/gm of catalyst.

The number and the strength of potential acid sites can be determined using any of a number of methods known to the art. For example, N. Topsφe, et.al., *Infrared and Temperature-Programmed Desorption Study of the Acidic Properties of ZSM-5-Type Zeolites*, J. Catalysis 70, 41–52(1981) describes infrared (IR) methods for studying acid-type catalysts.

Typically, acid site density is measured using finished catalysts which have been reduced in 1 atmosphere of hydrogen at about 400° F. A useful IR method includes heating a catalyst sample, in the form of a self-supporting wafer, under vacuum (about $10^{-6}$ torr) at 500° C. to remove volatiles from the catalyst, especially water. The catalyst sample is maintained at 450° C. for 12 hours and then cooled to 150° C. The catalyst sample is then dosed with a known amount of pyridine vapor (at approximately 1 torr pressure) which had been previously dried over activated Linde 5A molecular sieve and degassed using conventional freeze-pump-thaw techniques. An infrared spectra is taken of the sample, using, for example, a Nicolet 60SXR Fourier Transform Infrared (FT-IR) spectrometer. The areas under the 1453 $cm^{-1}$ and the 1543 $cm^{-1}$ bands give a measure of the protonic (Bronsted) acid site density and the non-protonic (Lewis) acid site density on the catalyst surface. The catalyst sample saturated with pyridine is further saturated with water vapor, and the infrared spectra scanned again. Adding water vapor will shift the ratio of Bronsted/Lewis acid site density. The peak areas of the two infrared scans provide enough detail for calculating the amount of pyridine adsorbed on the Bronsted and on the Lewis acid sites. The total acid site density is the sum of the site densities of the Lewis and Bronsted acids.

The techniques for determining catalyst acidity measure the number of catalyst sites in units of milliequivalents (meq) per gram of catalyst As used here, "milliequivalents" refers to 1 millimole of Lewis or Bronsted acid sites. The amount of adsorbed base is related to the acid site density, and the number of acid sites on which each adsorbent molecule will adsorb. An acid site density of 1 meq/gm catalyst is equivalent to having 1 millimole of base adsorb on a gram of catalyst, when each molecule of base adsorbs on a single acid site.

The density of acidic sites on a catalyst depend largely on the composition of the catalyst and/or how it is prepared. For example, increasing the amount of silica in a silica/alumina base material increases the acidity of a hydrogenation catalyst which contains the base material. Preferably, the base material of the catalyst of the present invention comprises at least 30 weight percent silica, and more preferably comprises at least 40 weight percent silica, and most preferably contains in the range of about 40 weight percent silica to about 99 weight percent silica.

Base materials suitable for preparing the catalysts used in the process of this invention are commercially available, for example, from Condea Chemie, GmbH of Hamburg, Germany, and base materials from Condea Chemie designated as "Siral 40" have been found to be particularly suitable to prepare catalysts employed in the present invention. Alternatively, the silica/alumina base materials are prepared using known coprecipitation, congelation, and/or comull procedures. Crystalline silica/alumina materials such as zeolites may also be included as part of the support of the hydrogenation catalysts to increase catalyst acidity.

Catalyst acidity may also be increased by addition of halides such as fluorine, chlorine, bromine, or compounds thereof to the catalyst. The halide may be added during preparation of the catalyst, either during formation of the support or by deposition onto the support. The halide may also be added to the catalyst as a minor component of the feed during the hydrogenation process. In either case, the halide is added to the catalyst in a suitable form, such as, for example, as a halide salt, a hydrogen halide, or an organic halide.

Catalyst acidity may also be increased by decreasing the amount of tramp metals in the catalyst support material. As used herein, the term "tramp metals" refers to the metals sodium, iron, potassium, calcium, and magnesium which are found in conventional supports. While silica/alumina materials having a tramp metals content below 500 ppm have only recently become available, the suitability of such high-purity silica/alumina materials in the preparation of hydrogenation catalysts would not have been expected from a study of the prior art. The absence of tramp metals in the base material is believed to increase the potential acid sites and, therefore, would be expected to have a tendency to make the support more acidic. The supports that are used to prepare the catalysts employed in the present invention will preferably contain a low concentration of tramp metals. Preferably, the tramp metal content of the supports is less than 500 ppm, and more preferably less than 350 ppm, as determined by Inductively Coupled Plasma Spectroscopy following fusion and acid dissolution. Still more preferably, the sodium content of the support is less than 200 ppm, as determined by neutron activation analysis.

Hydrogenation catalysts used in the process of the present invention will contain a hydrogenation component which comprises at least one metallic element or a compound thereof selected from the group consisting of the platinum group metals, nickel, cobalt, chromium, molybdenum, tungsten, and tin. As used herein, the term "platinum group metals" refers to the metals platinum, palladium, ruthenium, rhodium, osmium, and iridium. Similarly, the term "non-platinum group metals" refers to nickel, cobalt, chromium, molybdenum, tungsten, and tin. Particularly preferred among the platinum group metals are platinum and palladium with palladium being particularly preferred. While the hydrogenation catalysts utilized in the present invention will contain at least one metal, it is also possible to use combinations of two or more metals or their compounds, such as for example a combination of metals containing both platinum and palladium, or a combination containing both nickel and tungsten.

The amount of metal placed on the support must be sufficient to act as an effective catalyst in the hydrogenation of the lubricating oil base stock. Generally, the amount of platinum group metal on the support used to catalyze a hydrogenation process within the scope of the present invention will be within the range of from about 0.01 weight percent to about 5 weight percent, preferably the range is from about 0.1 weight percent to about 1 weight percent. Generally, adding greater than about 1 weight percent platinum group metals does not significantly improve on the activity of the catalyst and is therefore economically disadvantageous. However, amounts in excess of 1 weight percent are usually not harmful to the performance of the catalyst.

A number of methods are known in the art to deposit the platinum group metal or its compound onto the support, such as, for example, by ion exchange, impregnation, coprecipitation, etc. It has been found that the supports used in the catalyst of the present invention are particularly advantageous when impregnation of the platinum group metal is carried out under a controlled pH. The impregnation solution preferably will be buffered to maintain a pH within the range of from about 9 to about 10. Values outside of this pH range may be used to deposit the platinum group metal on the support, but the final distribution of the platinum group metal on the support may not be as favorable as those obtained within this pH range.

The platinum group metal is usually added to the impregnating solution as a metal salt, generally as an organic amine complex salt of a mineral acid. Ammonium salts have been found to be particularly useful in preparing the impregnating solution. Representative of the ammonium salts that may be used are nitrates, carbonates, bicarbonates and lower carboxylic acid salts such as acetates and formates. In the case of palladium, an ammonium nitrate salt or an ammonium chloride salt have been found to give satisfactory results. However, other salts of the platinum group metals are also operable and could be used to impregnate the support. In such case, it may be useful to determine the optimal pH to use during impregnation for the particular salt selected in order to obtain the best distribution of metals on the support. It has been found that excellent distribution of palladium will be obtained using the present support if an impregnating solution containing tetraamine palladium nitrate is buffered to a pH of from between about 9.6 and about 10.

Following impregnation, the impregnated support should be allowed to stand before drying for a period of time sufficient for it to attain equilibration with the impregnating solution. For an extrudate, this period usually is at least 2 hours, and periods of up to 24 hours are not detrimental to the finished catalyst. A suitable time for a given support may be readily determined by one skilled in the art having regard to this disclosure by, for example, drying at various times after impregnation and measuring the metal distribution.

Following impregnation and standing, the catalyst is again dried and/or calcined. The prepared catalyst may be reduced with hydrogen as is conventional in the art and placed into service.

When metals other than the platinum group metals are employed in the present process, the amount of non-platinum group metals will be within the range of from about 1 weight percent to about 50 weight percent, preferably within the range of from about 2 weight percent to about 30 weight percent, based on the finished weight of catalyst. Typically, the non-platinum group metals, or compounds thereof, will be composited with the support using one or more of a number of methods available to the art, such as, for example, by impregnation, coprecipitation, comulling, and the like.

Feedstock

A lubricating oil base stock is a petroleum stream that is useful for the production of lubricating oils. Lubricating oil base stocks generally boil in the range from 500° F. to 1300° F., and have a kinematic viscosity (measured at 100° C.) greater than about 3 cSt. A lubricating oil base stock will generally have been pretreated prior to hydrofinishing. Pretreatment processes may include, for example, one or more of hydrocracking, solvent extraction, and/or dewaxing to lower the pour point. Following hydrofinishing, the lubricating oil base stocks may be further treated to meet specific quality specifications, such as by dewaxing. Dewaxing may be carried out by conventional means known in the art such as, for example, by solvent extraction or by catalytic dewaxing.

As stated above, the lubricating oil base stock may have been treated by hydrocracking prior to the hydrogenation process of this invention. The hydrocarbonaceous feeds that are suitable for use in preparing lubricating oil base stock by hydrocracking usually contain aromatic compounds as well as normal and branched paraffins of very long chain lengths. Preferred feedstocks are vacuum gas oils and deasphalted residual oils. Reduced topped crude oils, shale oils, liquefied coal, coke distillates, flask or thermally cracked oils, atmospheric residua, and other heavy oils can also be used as a source of feedstock. Hydrocracking processes typically include reaction temperatures in the range of 250° C. to 500° C., pressures in the range of 30 to 205 bar or more, a hydrogen recycle rate of 100 to 1100 SCM/KL, and an LHSV (v/v hr) of 0.1 to 10. Hydrocracking catalysts, which are well known to the art of hydroprocessing technology, will typically contain one or more metals, or compounds thereof, selected from Group VIB and Group VIII of the Periodic Table. Hydrocracking catalysts also typically include a support material of a refractory inorganic oxide such as silica-alumina, silica-alumina-zirconia, and silica-alumina-titania composites, acid treated clays and combinations thereof, and optionally may also include crystalline aluminosilicate zeolitic molecular sieves (such as Zeolite A, faujasite, Zeolite X, and Zeolite Y).

Lubricating oil base stocks that are suitable for use in the present invention also may be recovered from a solvent extraction process. In solvent extraction, a distillate fraction, generally a vacuum gas oil, which optionally has been desulfurized, is contacted with a solvent, such as N-methyl pyrrolidone or furfural, in a solvent extraction zone, preferably employing a countercurrent extraction unit. The aromatics-lean raffinate is stripped of solvent, optionally dewaxed, and subsequently hydrogenated to improve product stability and color. The recovered solvent is usually recycled.

Hydrogenation Process

The process of the present invention is directed to hydrogenation of lubricating oil base stocks, and in particular to those lubricating oil base stocks which have been hydrocracked. The hydrogenation reaction takes place in the presence of hydrogen, preferably at hydrogen pressures in the range of between about 500 psia and 4000 psia, more preferably in the range of about 900 psia to about 3000 psia. The feed rate to the hydrogenation catalyst system is in the range of from about 0.2 to about 1.5 LHSV, preferably in the range of about 0.2 to about 1.0 LHSV, more preferably in the range of 0.3 to 0.7 LHSV. The hydrogen supply (makeup and recycle) is in the range of from about 500 to about 20,000 standard cubic feet per barrel of lubricating oil base stock, preferably in the range of from about 2000 to about 10,000 standard cubic feet per barrel.

As disclosed above, the lubricating oil base stock is hydrogenated sequentially in a first hydrogenation zone followed by a second hydrogenation zone. The first zone may contain the macroporous hydrogenation catalyst, in which case the second zone will contain the mesoporous hydrogenation catalyst. With this arrangement of catalysts in the two zones, the reaction temperature of the second zone is at least as high as the reaction temperature of the first zone. It is preferred that the reaction temperature in the second zone be in the range of between about 0° F. and about 300° F. higher than the reaction temperature in the first zone. Generally, the reaction temperature in the first zone, containing the macroporous hydrogenation catalyst, is up to about 500° F., preferably in the range of between about 400° F. and 500° F.; and the reaction temperature in the second zone, containing the mesoporous catalyst, is in the range of between about 400° F. and about 725° F., preferably 450° F. to 725° F. and more preferably in the range of between about 450° F. and about 650° F.

Alternatively, the first hydrogenation zone may contain the mesoporous hydrogenation catalyst, in which case the second hydrogenation zone will contain the macroporous hydrogenation catalyst. In this embodiment, the reaction temperature in the first zone is generally higher than the reaction temperature in the second zone. It is preferred that the reaction temperature in the first zone be in the range of between about 10° F. and 300° F. higher than the reaction temperature in the second zone. Generally, the reaction temperature in the first zone, containing the mesoporous catalyst, is in the range of between about 400° F. and about 725° F., preferably 450° F. to 725° F., and more preferably in the range of between about 450° F. and about 650° F.; and the reaction temperature in the second zone, containing the macroporous hydrogenation catalyst, is up to about 500° F., preferably in the range of between about 400° F. and 500° F.

Although the present invention is not to be limited by any theory of operation, it is believed the polycyclic aromatic compounds, i.e., greater than three rings, which are one source of instability in lubricating oil base stocks, are most efficiently hydrogenated at lower reaction temperatures using a macroporous hydrogenation catalyst, which has a pore structure which allows the polycyclic aromatic compounds to enter the catalyst and react. The one- to three-ring aromatic molecules, which are an additional source of instability, are best hydrogenated at higher temperatures with a mesoporous catalyst. In this way a hydrogenation process is provided having a catalyst system with increased activity and long life for producing lubricating oil base stocks having improved stability.

The following examples are presented to illustrate specific embodiments of the practice of this invention and should not be interpreted as limitations upon the scope of the invention.

EXAMPLES

Example 1

Preparation of a Mesoporous Catalyst Support

A dry mixture of 1.32 kg volatiles-free Condea Plural SB alumina powder, 10.68 kg volatiles-free Condea Siral 40 silica/alumina powder (40 weight percent $SiO_2$), both available from Condea Chemie GmbH, Hamburg, West Germany, and 360 grams Dow Chemical Company Methocel F4M powder was blended in a Littleford mixer. The blended powders were then wetted with a spray of 10.0 kg of deionized water, and 2.21 kg of nitric acid (1.71 kg of 70% $HNO_3$ in 1.5 kg deionized water) were sprayed on the wetted powder to peptize the powders. The peptized powders were then mixed an additional 10 minutes. During mixing, an additional 500 cc deionized water were added to improve extrusion. A portion of the peptized mixture was then extruded in a Bonnet mixer through a 0.071 inch die plate. The extrudates were dried in flowing dry air at 150° F. for 30 minutes, then at 200° F. for 30 minutes, then at 300° F. for 1 hour, and then calcined by heating in 20 $ft^3$/hr dry air to 1100° F. at 500° F./hour, then to 1300° F. at 300° F./hour, and then holding at 1300° F. for 1 hour before cooling.

Example 2

Preparation of a Macroporous Catalyst Support

A dry mixture of 1.32 kg volatiles-free Condea Plural SB alumina powder, 10.68 kg volatiles-free Condea Siral 40 silica/alumina powder (40 weight percent $SiO_2$) and 360 grams Dow Chemical Company Methocel F4M powder were blended in a Littleford mixer. The blended powders were then wetted with a spray of 11.0 kg of deionized water, and 3.21 kg of nitric acid (0.171 kg of 70% $HNO_3$ in 3.039 kg deionized water) were sprayed on the wetted powder to peptize the powders. The peptized powders were then mixed an additional 10 minutes. A portion of the peptized mixture was then extruded in a Bonnet mixer through a 0.073 inch die plate. The extrudates were dried in flowing dry air at 150° F. for 30 minutes, then at 200° F. for 30 minutes, then at 300° F. for 1 hour, and then calcined by heating in 20 $ft^3$/hr dry air to 1100° F. at 500° F./hour, then to 1300° F. at 300° F./hour, and then holding at 1300° F. for 1 hour before cooling.

The supports of Examples 1 and 2 had the following properties:

| Physical Property | Example 1 Support | Example 2 Support |
|---|---|---|
| Particle Density | 1.20 g/$cm^3$ | 0.940 g/$cm^3$ |
| Total Pore Volume by Hg Porosimetry | 0.352 $cm^3$/g | 0.5957 $cm^3$/g |
| Macropore Volume | 0.005 $cm^3$/g | 0.123 $cm^3$/g |
| Percent Macropore Volume | 1.4% | 20.6% |

Example 3

Preparation of a Macroporous Catalyst

A hydrogenation catalyst was prepared using 220 grams (volatiles-free basis) of a macroporous catalyst support which has been equilibrated for 1 hour at ambient conditions. A palladium solution was prepared by dissolving 2.82 grams of tetraamine palladium nitrate ($Pd(NH_3)_4(NO_3)_2$) in a solution containing 10%

$NH_4NO_3$ in deionized water which contained sufficient $NH_4OH$ to maintain the pH in the range 9.6–10.0.

The equilibrated macroporous catalyst support was impregnated with the palladium solution by spray pore fill to a nominal loading of 0.5 weight percent Pd on the finished catalyst. Enough palladium solution was sprayed onto the support over a period of 10 to 15 minutes to fill the pore volume of the support. The support was then allowed to soak for 4 hours, with additional shaking each 30 minutes. During the soak, water was added as required to keep the surfaces of the catalyst damp.

After soaking overnight, the impregnated support was dried for 30 minutes at 200° F. and then for 1 hour at 300° F., and was then calcined in 20 $ft^3$/hr dry air by heating to 850° F. at 300° F./hour, and holding at 850° F. for 8 hours. The macroporous catalyst of Example 3 was labeled Catalyst A.

Example 4

Preparation of a Mesoporous Catalyst

A hydrogenation catalyst was prepared using 320 grams (volatiles-free basis) of a mesoporous catalyst support which has been equilibrated overnight at ambient conditions. A palladium solution was prepared by dissolving 4.23 grams of tetraamine palladium nitrate ($Pd(NH_3)_4(NO_3)_2$) in a solution containing 10% $NH_4NO_3$ in deionized water which contained sufficient $NH_4OH$ to maintain a pH in the range 9.6–10.0.

The equilibrated mesoporous catalyst support was impregnated with the palladium solution by spray pore fill to a nominal loading of 0.5 weight percent Pd on the finished catalyst. Enough palladium solution was sprayed onto the support over a period of 10 to 15 minutes to fill the pore volume of the support. The support was then allowed to soak for 4 hours, with additional shaking each 30 minutes. During the soak, water was added as required to the support to keep it damp.

After soaking overnight, the impregnated support was dried for 30 minutes at 200° F. and then for 1 hour at 300° F., and was then calcined in 20 $ft^3$/hr dry air by heating to 850° F. at 300° F./hour, and holding at 850° F. for 8 hours. The mesoporous catalyst of Example 4 was labeled Catalyst B.

Catalyst A, prepared using a macroporous catalyst support, and Catalyst B, prepared using a mesoporous catalyst support, had physical properties as follows:

| | Catalyst A | Catalyst B |
|---|---|---|
| Particle Density, g/$cm^3$ | 0.750 | 1.107 |
| BET Surface Area, $m^2$/g | 366 | 372 |
| Total Pore Volume, $cm^3$/g | 0.820 | 0.497 |
| Macropore volume, $cm^3$/g | 0.34 | 0.029 |
| $SiO_2/Al_2O_3$ mole ratio | 0.86 | 0.78 |
| Acid Density @ 150° C., mEq/g | 0.197 | 0.186* |
| Percent Macropore Volume | 41.4% | 5.8% |
| Metal Content | | |
| Pd, wt % | 0.47 | 0.53 |
| Ca, ppm | 93 | 301 |
| Na, ppm | 70 | 30 |
| Mg, ppm | <70 | 139 |
| Fe, ppm | 168 | 170 |
| Ni, ppm | 83 | 60 |
| Pb, ppm | 271 | 121 |

*Estimated value

Example 5

Hydrogenation Test

A lube oil base stock was hydrogenated at 450° F., 2400 psig hydrogen pressure and 0.5 cc feed per hour/cc catalyst, with concurrent downflow of hydrocarbon and hydrogen feeds contacting the following catalyst systems:

| Test No. | Catalyst System |
|---|---|
| 5-1 | 100% Catalyst A |
| 5-2 | 100% Catalyst B |
| 5-3 | 50 vol % Catalyst A/50 vol % Catalyst B |

An activity function was used to describe the removal of one- to three-ring aromatics during hydrogenation, based on ultra-violet absorbance measurements at 226 nm, where higher activity functions indicate higher catalyst activity. The hydrogenation test was conducted for at least 700 hours to determine the catalyst activity and the stability of the activity to catalyst fouling of each of the catalyst systems tested.

FIG. 1 shows that Catalyst A, the macroporous catalyst, was slightly more active than Catalyst B, the mesoporous catalyst. The rate of catalyst fouling of Catalyst A was higher than that of Catalyst B, so that after 700 hours on stream, the catalysts appeared to have equal activity. In contrast, the layered catalyst system, with 50 vol % Catalyst A in a first hydrogenation zone and 50 vol % Catalyst B in a second hydrogenation zone, was as active as Catalyst A during the first 200 hours of operation, but more resistant to catalyst fouling than either catalyst alone. FIG. 1 also shows that, after 300 hours of operation, the hydrogenated lubricating oil base stock prepared by utilizing the layered catalyst system in accordance with this invention would be more stable than the hydrogenated base stock prepared by utilizing either the macroporous catalyst or the mesoporous catalyst alone at 450° F.

Example 6

Preparation of Mesoporous Catalysts

Catalyst C and Catalyst D were prepared on mesoporous catalyst supports using methods similar to those described in Examples 1 and 4. The properties of Catalysts C and D were as follows:

| | Catalyst C | Catalyst D |
|---|---|---|
| Particle Density, g/$cm^3$ | 0.952 | 0.839 |
| BET Surface Area, $m^2$/g | 396 | 384 |
| Total Pore Volume, $cm^3$/g | 0.629 | 0.760 |
| Macropore volume, $cm^3$/g | 0.031 | 0.062 |
| $SiO_2/Al_2O_3$ mole ratio | 0.62 | 0.62 |
| Acid Density @ 150° C., mEq/g | 0.161 | 0.182 |
| Percent Macropore Volume | 4.9% | 8.2% |
| Metal Content | | |
| Pd, wt % | 0.714 | N/A |
| Ca, ppm | 609 | 535 |
| Na, ppm | 783 | 650 |
| Mg, ppm | 359 | N/A |
| Fe, ppm | 378 | N/A |
| Ni, ppm | 403 | N/A |
| Pb, ppm | 313 | N/A |

N/A = data not available

Example 7

Preparation of Macroporous Catalysts

Catalyst E and Catalyst F were prepared on macroporous catalyst supports using methods similar to those described in Examples 2 and 3. The properties of Catalysts E and F were as follows:

| | Catalyst E | Catalyst F |
|---|---|---|
| Particle Density, g/cm$^3$ | 0.842 | 0.801 |
| BET Surface Area, m$^2$/g | 386 | 313 |
| Total Pore Volume, cm$^3$/g | 0.766 | 0.822 |
| Macropore volume, cm$^3$/g | 0.113 | 0.123 |
| $SiO_2/Al_2O_3$ mole ratio | 0.65 | 0.68 |
| Acid Density @ 150° C., mEq/g | 0.164 | 0.178 |
| Percent Macropore Volume | 14.8% | 15.0% |
| Metal Content | | |
| Pd, wt % | 0.758 | 0.720 |
| Ca, ppm | 468 | 569 |
| Na, ppm | 504 | 574 |
| Mg, ppm | 190 | 413 |
| Fe, ppm | 179 | 254 |
| Ni, ppm | N/A | 43 |
| Pb, ppm | N/A | 296 |

What is claimed is:

1. A process for producing a hydrogenated lubricating oil base stock having improved stability comprising the steps of:

(a) contacting the lubricating oil base stock with hydrogen in a first hydrogenation zone under hydrogenation reaction conditions in the presence of a macroporous hydrogenation catalyst comprising a particulate refractory inorganic oxide support component and a hydrogenation component, said macroporous hydrogenation catalyst having (i) an acid site density of between about 0.015 and about 0.3 milliequivalents per gram of catalyst;

(ii) a total pore volume greater than about 0.45 cm$^3$/g; and (iii) at least 10% of the total pore volume being in macropores of diameter greater than about 1000 Angstroms;

(b) contacting at least a portion of the effluent from step (a) with hydrogen in a second hydrogenation zone under hydrogenation reaction conditions in the presence of a mesoporous hydrogenation catalyst comprising a particulate refractory inorganic oxide support component and a hydrogenation component, said mesoporous hydrogenation catalyst having (i) an acid site density of between about 0.015 and about 0.3 milliequivalents per gram of catalyst;

(ii) a total pore volume greater than about 0.30 cm3/g; and (iii) less than 10% of the total pore volume being in macropores of diameter greater than about 1000 Angstroms; and (c) recovering a hydrogenated lubricating oil base stock having improved stability.

2. The process as recited in claim 1, wherein the macroporous hydrogenation catalyst has an acid site density of between about 0.1 and about 0.2 milliequivalents per gram of catalyst.

3. The process as recited in claim 1, wherein the support component of the macroporous hydrogenation catalyst comprises an oxide base material comprising silica and alumina.

4. The process as recited in claim 3, wherein the oxide base material of the macroporous hydrogenation catalyst comprises at least 30 weight percent silica.

5. The process as recited in claim 4, wherein the oxide base material of the macroporous hydrogenation catalyst comprises at least 40 weight percent silica.

6. The process as recited in claim 3, wherein the oxide base material of the macroporous hydrogenation catalyst contains less than 350 ppm each of the metals sodium, iron, potassium, calcium, and magnesium.

7. The process as recited in claim 6, wherein the oxide base material of the macroporous hydrogenation catalyst contains less than 200 ppm of sodium.

8. The process as recited in claim 3, wherein the support component of the macroporous hydrogenation catalyst further comprises an oxide binder.

9. The process as recited in claim 8, wherein the oxide binder is alumina.

10. The process as recited in claim 9, wherein the weight ratio of oxide base material to oxide binder of the macroporous hydrogenation catalyst is between about 30/70 and about 96/4.

11. The process as recited in claim 1, wherein the hydrogenation component of the macroporous hydrogenation catalyst comprises at least one metallic element, or compound thereof, selected from the group consisting of the platinum group metals, nickel, cobalt, chromium, molybdenum, tungsten, and tin.

12. The process as recited in claim 11, wherein the hydrogenation component of the macroporous hydrogenation catalyst comprises at least one metallic element selected from the group consisting of platinum and palladium.

13. The process as recited in claim 12, wherein the hydrogenation component of the macroporous hydrogenation catalyst is palladium.

14. The process as recited in claim 1, wherein the macroporous hydrogenation catalyst has a surface area of greater than about 100 m$^2$/g.

15. The process as recited in claim 1, wherein the mesoporous hydrogenation catalyst has an acid site density of between about 0.1 and about 0.2 milliequivalents per gram of catalyst.

16. The process as recited in claim 1, wherein the support component of the mesoporous hydrogenation catalyst comprises an oxide base material comprising silica and alumina.

17. The process as recited in claim 16, wherein the oxide base material of the mesoporous hydrogenation catalyst comprises at least 30 weight percent silica.

18. The process as recited in claim 17, wherein the oxide base material of the mesoporous hydrogenation catalyst comprises at least 40 weight percent silica.

19. The process as recited in claim 16, wherein the oxide base material of the mesoporous hydrogenation catalyst contains less than 350 ppm each of the metals sodium, iron, potassium, calcium, and magnesium.

20. The process as recited in claim 19, wherein the oxide base material of the mesoporous hydrogenation catalyst contains less than 200 ppm of sodium.

21. The process as recited in claim 16, wherein the particulate refractory inorganic oxide support component of the mesoporous hydrogenation catalyst further comprises an oxide binder.

22. The process as recited in claim 21, wherein the oxide binder is alumina.

23. The process as recited in claim 22, wherein the weight ratio of oxide base material to oxide binder of the mesoporous hydrogenation catalyst is between about 30/70 and about 96/4.

24. The process as recited in claim 1, wherein the hydrogenation component of the mesoporous hydrogenation catalyst comprises at least one metallic element, or compound thereof, selected from the group consisting of the platinum group metals, nickel, cobalt, chromium, molybdenum, tungsten, and tin.

25. The process as recited in claim 24, wherein the hydrogenation component of the mesoporous hydrogenation catalyst comprises at least one metallic element selected from the group consisting of platinum and palladium.

26. The process as recited in claim 25, wherein the hydrogenation component of the mesoporous hydrogenation catalyst is palladium.

27. The process as recited in claim 1, wherein the mesoporous hydrogenation catalyst is characterized as having a surface area of greater than about 100 $m^2/g$.

28. The process as recited in claim 1, wherein the hydrogenation reaction conditions in the first hydrogenation zone comprise a reaction temperature in the range of 400° F. to 500° F., and a hydrogen partial pressure in the range of between about 500 psia and 4000 psia.

29. The process as recited in claim 1, wherein the hydrogenation reaction conditions in the second hydrogenation zone comprise a reaction temperature in the range of 400° F. to 725° F., and a hydrogen partial pressure in the range of between about 500 psia and 4000 psia.

30. The process as recited in claim 1, wherein the reaction temperature in the second hydrogenation zone is between about 0° F. and 300° F. higher than the reaction temperature in the first hydrogenation zone.

31. The process as recited in claim 1, wherein the volume ratio of the macroporous hydrogenation catalyst to mesoporous hydrogenation catalyst is in the range of between about 90:10 to about 10:90.

32. The process as recited in claim 1, wherein the macroporous hydrogenation catalyst has a minimum macropore volume of greater than 0.07 $cm^3/g$.

33. The process as recited in claim 1, wherein the mesoporous hydrogenation catalyst has a maximum macropore volume of 0.07 $cm^3/g$.

34. A process for producing a hydrogenated lubricating oil base stock having improved stability comprising the steps of:

(a) contacting the lubricating oil base stock with hydrogen in a first hydrogenation zone under hydrogenation reaction conditions in the presence of a mesoporous hydrogenation catalyst comprising a particulate refractory inorganic oxide support component and a hydrogenation component, said mesoporous hydrogenation catalyst having
  (i) an acid site density of between about 0.015 and about 0.3 milliequivalents per gram of catalyst;
  (ii) a total pore volume greater than about 0.30 $cm^3/g$; and
  (iii) less than 10% of the total pore volume being in macropores of diameter greater than about 1000 Angstroms;

(b) contacting at least a portion of the effluent from step (a) with hydrogen in a second hydrogenation zone under hydrogenation reaction conditions in the presence of a macroporous hydrogenation catalyst comprising a particulate refractory inorganic oxide support component and a hydrogenation component, said macroporous hydrogenation catalyst having
  (i) an acid site density of between about 0.015 and about 0.3 milliequivalents per gram of catalyst;
  (ii) a total pore volume greater than about 0.45 $cm^3/g$; and
  (iii) at least 10% of the total pore volume being in macropores of diameter greater than about 1000 Angstroms; and (c) recovering a hydrogenated lubricating oil base stock having improved stability.

35. The process as recited in claim 34, wherein the hydrogenation reaction conditions in the first hydrogenation zone comprise a reaction temperature in the range of 400° F. to 725° F., and a hydrogen partial pressure in the range of between about 500 psia and 4000 psia.

36. The process as recited in claim 34, wherein the hydrogenation reaction conditions in the second hydrogenation zone comprise a reaction temperature in the range of 400° F. to 500° F., and a hydrogen partial pressure in the range of between about 500 psia and 4000 psia.

37. The process as recited in claim 34, wherein the reaction temperature in the first hydrogenation zone is between about 10° F. and 300° F. higher than the reaction temperature in the second hydrogenation zone.

38. The process as recited in claim 34, wherein the volume ratio of the mesoporous hydrogenation catalyst to macroporous hydrogenation catalyst is in the range of between about 90:10 to about 10:90.

39. The process as recited in claim 34, wherein the macroporous hydrogenation catalyst has a minimum macropore volume of greater than 0.07 $cm^3/g$.

40. The process as recited in claim 34, wherein the mesoporous hydrogenation catalyst has a maximum macropore volume of 0.07 $cm^3/g$.

* * * * *